United States Patent [19]

Luconi

[11] Patent Number: 4,961,236

[45] Date of Patent: Oct. 9, 1990

[54] MATTRESS POSITION ADJUSTMENT DEVICE

[76] Inventor: Lanzo E. Luconi, P.O. Box 44-1000, San Jose, Costa Rica

[21] Appl. No.: 459,435

[22] Filed: Jan. 2, 1990

[51] Int. Cl.[5] ..... A61G 7/06

[52] U.S. Cl. ..... 5/71; 5/77; 5/433

[58] Field of Search ..... 5/66, 71, 77, 72, 432, 5/433; 248/371; 108/7

[56] References Cited

U.S. PATENT DOCUMENTS

| | | | |
|---|---|---|---|
| 796,494 | 8/1905 | Brennan | 5/72 |
| 1,818,598 | 8/1931 | Berry | 5/72 |
| 2,211,453 | 8/1940 | Buttikofer | 5/77 |
| 2,536,534 | 1/1951 | Carter | 5/72 |
| 3,055,019 | 9/1962 | Agiman | 5/71 |
| 3,191,195 | 6/1965 | Schlackman et al. . | |
| 3,646,621 | 3/1972 | Fragas | 5/66 |
| 3,750,200 | 8/1973 | Hirmann . | |
| 3,781,928 | 1/1974 | Swallert . | |
| 4,435,862 | 3/1984 | King et al. . | |
| 4,613,997 | 9/1986 | Langdale | 5/72 |
| 4,667,354 | 5/1987 | Carey | 5/72 |
| 4,751,755 | 6/1988 | Carey | 5/72 |

*Primary Examiner*—Michael F. Trettel
*Assistant Examiner*—Flemming Saether
*Attorney, Agent, or Firm*—Timothy R. Kroboth

[57] ABSTRACT

The present invention provides a mattress position adjustment device. The device includes a lifting frame and a support frame. Each free end of the lifting frame is pivotally joined to an upper crossbar of the support frame by a hinge. The upper crossbar has an elongated opening through which extends a hydraulic device that is pivotally joined to and directly connected to the lifting frame.

4 Claims, 4 Drawing Sheets

MATTRESS POSITION ADJUSTMENT DEVICE

BACKGROUND OF THE INVENTION

This invention relates to a device useful with an existing bedframe, for raising and lowering a portion of a mattress.

Devices for raising and lowering a portion of a bed mattress are well known. In the most common type of such device, the adjustment mechanism is part of the bed structure. As is easily understood, a device that can be added to and removed from an existing bedframe is more adaptable and can be provided at a lower cost. For purposes of this discussion of this invention, by "bedframe" is meant bed rails, and supporting legs therefor.

Devices for adjusting the position of a portion of a bed mattress are exemplified by U.S. Pat. Nos. 3,191,195 to Schlackman et al, 3,750,200 to Hirmann, 3,781,928 to Swallert, and 4,435,862 to King et al.

The Hirmann patent is directed to a device for hydraulically setting the position of a bed. The device includes an inflatable hose connected to a source of low-pressure water. The Schlackman et al patent pertains to a hospital-type bed that includes, as part of the bed structure, hydraulic pistons and cylinders for raising and lowering portions of the bed rails.

The King et al patent relates to a control arrangement for a motor driven adjustable bed. The microprocessor control provides for bed adjustment in response to command signals indicating selected bed positions. The Swallert patent is directed to a device useful with an existing bedframe. The device includes a pneumatically inflatable pad disposed between pivotally joined, U-shaped, upper and lower frames.

However, there continues to be a need for an improved device useful with an existing bedframe, for raising and lowering a portion of a mattress. For instance, the inflatable member of the Swallert patent is vulnerable to puncture. Beneficially, such an improved device would be capable of improved automatic operation. Advantageously, such an improved device could adjust the mattress of a full size bed, of a queen size bed, or even a king size bed.

SUMMARY OF THE INVENTION

It is accordingly an object of the present invention to provide an improved mattress position adjustment device that can be added to and removed from an existing bedframe.

It is a further object to provide a device that provides improved automatic operation.

It is a still further object to provide a device that is able to adjust the mattress of a full size bed, of a queen size bed, or a king size bed.

Additional objects, advantages and novel features of the present invention are set forth in the description that follows, and in part will become apparent to those skilled in the art upon examination of the following description or may be learned by practice of the invention. The objects and advantages of the invention may be realized and attained by means of instrumentalities and combinations particularly pointed out in the appended claims.

To achieve the foregoing objects and in accordance with the purpose of the present invention, as embodied and broadly described herein, there is provided a mattress position adjustment device. The device includes a lifting frame for raising and lowering a portion of a mattress supported thereby, and a support frame. The support frame includes legs, and crossbars connecting the legs.

Each free end of the lifting frame is pivotally joined to an upper crossbar of the support frame by a hinge. The upper crossbar has an elongated opening through which extends a hydraulic device. The hydraulic device is supported by and pivotally joined to a lower crossbar of the support frame, on the respective side of the support frame. The hydraulic device is pivotally joined to and directly connected to the lifting frame. The elongated opening provides for angular movement of the hydraulic device as the lifting frame is raised and lowered.

In the drawing and in the detailed description of the invention that follows, there are shown and essentially described only preferred embodiments of this invention, simply by way of illustration of the best mode contemplated of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing, which form a part of the specification of the present invention, and which depicts preferred embodiments of an improved mattress position adjustment apparatus in accordance the present invention.

DETAILED DESCRIPTION OF THE INVENTION

As explained above, the present invention is directed to an improved device for raising and lowering a portion of a mattress. The device is easily added to and removed from an existing bedframe. The device provides for automatic timed operation, and can be used to adjust simultaneously or separately the upper sections of a full size bed mattress, a queen size bed mattress, or a king size bed mattress.

Figure 1:
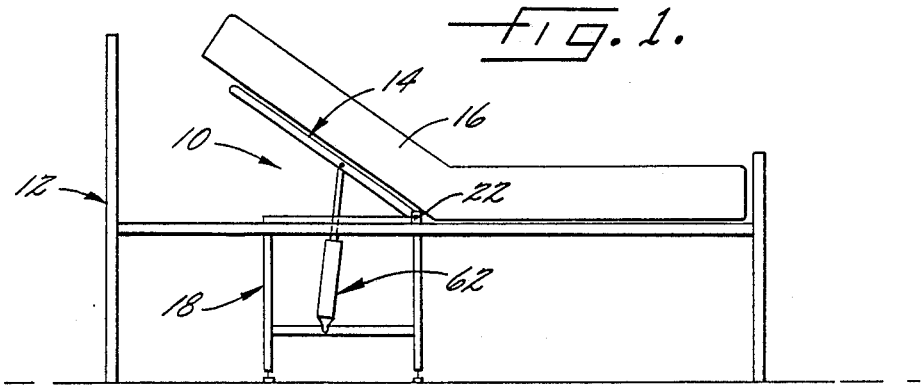
FIG. 1 is a simplified side elevation view of a bedframe provided with a first embodiment of an adjustment apparatus in accordance with the present invention, with a head end of a mattress supported in a semi-raised position by the adjustment apparatus.

Referring to the simplified drawing of FIG. 1, a preferred embodiment of an apparatus 10 in accordance with the present invention, is shown in combination with a bedframe 12. Apparatus 10 includes a lifting frame 14 for supporting a portion of a mattress 16, and includes a support frame 18. The head end of the mattress is shown in a semi-elevated position.

Figure 2:
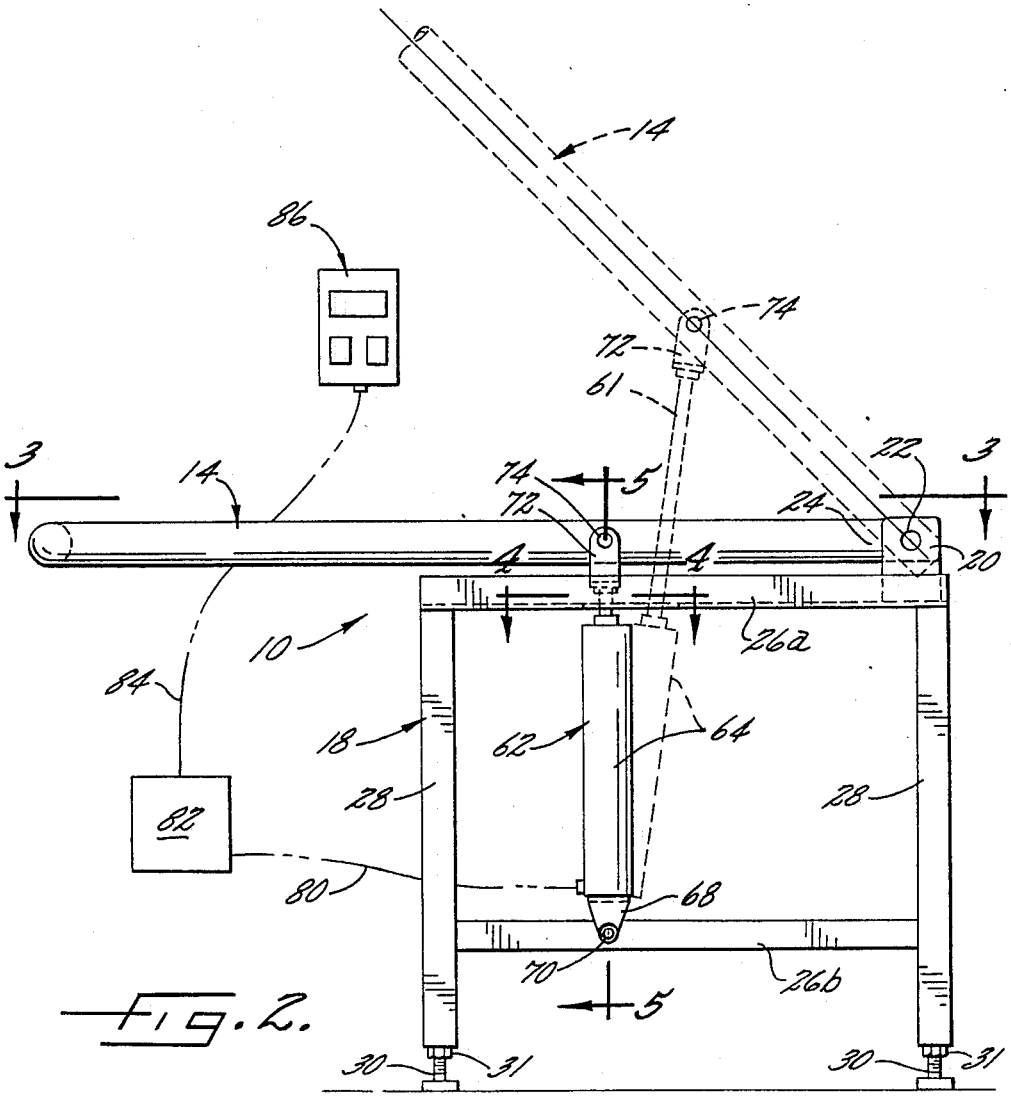
FIG. 2 is a detailed side view of the apparatus of FIG. 1, showing a lifting frame in lowered position in solid lines, and a portion of the lifting frame in semi-raised position in dotted lines.
Figure 3:
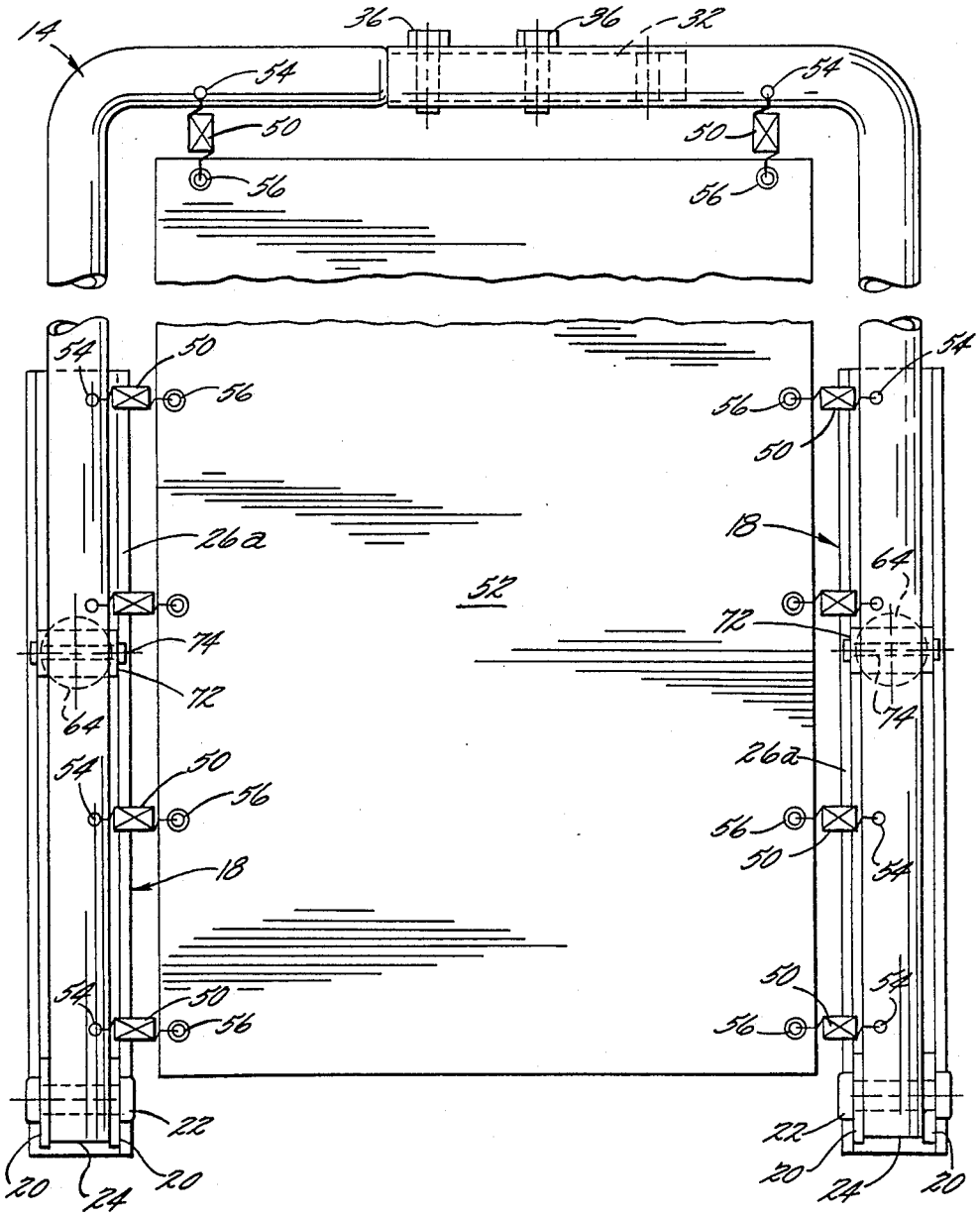
FIG. 3 is a top view of the apparatus looking along the line 3—3 in FIG. 2, the lifting frame being in lowered position.

With reference to FIGS. 2 and 3, on each side of the support frame, a hinge 20 which includes a pin 22, pivotally joins a free end 24 of U-shaped, lifting frame 14 to an upper crossbar 26*a* of the support frame, to which the hinge is fixedly attached. The lifting frame is conveniently tubular. The support frame is formed by legs 28, and crossbars 26 connecting the legs. If desired for visual enhancement, a decorative panel could be attached to each side of the support frame.

The legs advantageously include lower telescoping members 30 and lock nuts 31 for height adjustment. Likewise, lifting frame 14 includes inner telescoping part 32 and bolts 36 for adjustment of the width (as shown in FIG. 3).

Beneficially attached to the lifting frame by tensors 50 is a mattress support 52, which is conveniently of canvas, on which mattress 16 is placed. The tensors are anchored,in slots 54,56 in lifting frame 14 and mattress support 52, respectively.

Figure 4:
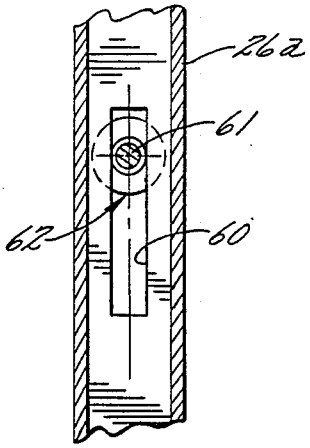
FIG. 4 is a partial section view of the support frame; upper crossbar taken along the line 4—4 in FIG. 2.
Figure 5:
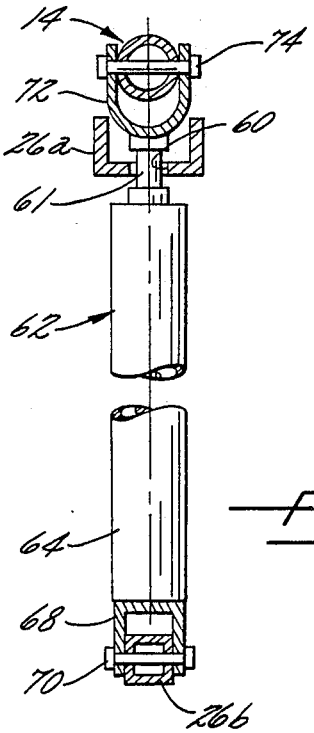
FIG. 5 is a partial cross-sectional view taken substantially along the line 5—5 in FIG. 2.

Referring now to FIGS. 4 and 5, upper crossbar 26*a* on each side of the support frame, has an elongated opening 60 through which the rod end 61 of a hydraulic device 62 extends. The cylinder housing 64 of the hydraulic device is supported by a lower crossbar 26*b* on the respective side of the support frame, and piston rod 61 of the hydraulic device is beneficially directly connected to lifting frame 14, as shown in FIG. 2, at a location suitably spaced apart from pin 22. A pivotal attachment of the hydraulic device is provided to lower crossbar 26*b* by a U-shaped bracket 68 and a hinge pin 70, and to the lifting frame 14 by a U-shaped bracket 72 and a hinge pin 74.

Referring again to FIG. 2, hydraulic device 62 is shown in a closed or retracted position in solid lines, and in an open or extended position in dotted lines. A hydraulic device on each side of the support frame 18 is connected, via a hydraulic line 80, to a conventional motor driven hydraulic pump, sump chambers and the like, which are represented by a box and designated 82. If lifting frame 14 is to be raised, the cylinders of the two hydraulic devices of the apparatus, are fed with driving fluid through the respective hydraulic lines.

Figure 6:
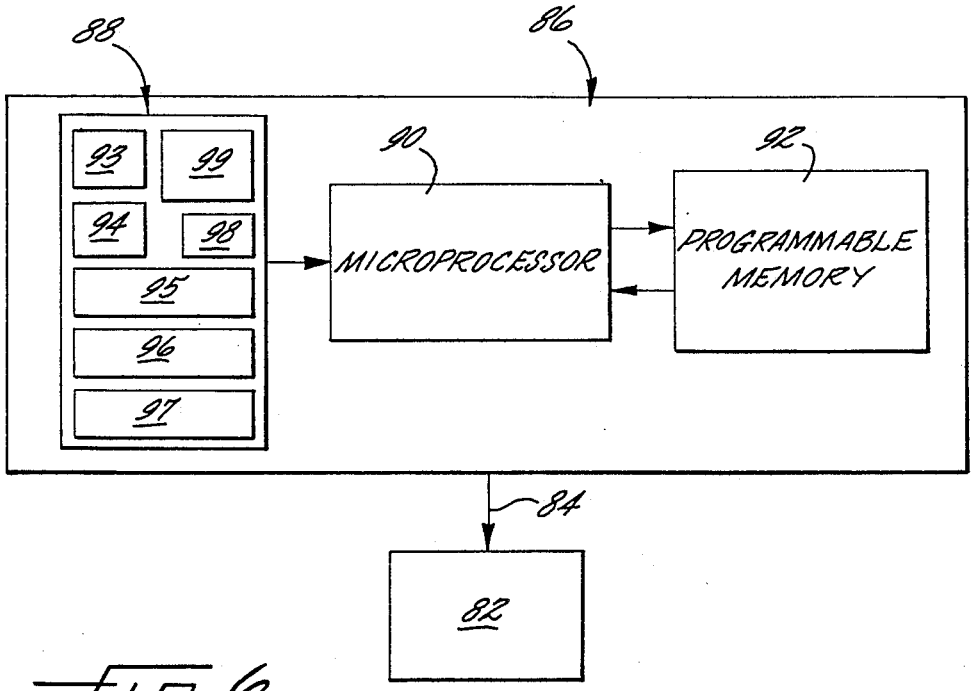
FIG. 6 is a block diagram of the control unit shown in FIG. 2, showing greater detail for the control panel of the control unit.

In communication with fluid pressure-producing system 82, conveniently via line 84, is a control unit 86, shown in block diagram in FIG. 6. Unit 86 beneficially includes a control panel 88, a conventional microprocessor 90 and a conventional programmable memory 92, which operatively intercommunicate.

Control panel 88, which is represented in detail in FIG. 6, includes manually actuable actuators for raising or lowering the lift frame, indicated at 93,94, respectively; for presetting a time of the lift frame being raised or lowered, indicated at 95; for putting the control panel into a program mode, indicated at 96; for clearing a prior program, indicated at 97; and for turning the control unit power on or off, indicated at 98. The control panel further includes a readout panel, cohveniently an LCD display, indicated at 99.

In the programmable mode, the control panel generates a command signal indicative of a certain selected time for automatic raising or lowering of lift frame 14, and communicates the same to the programmable memory via the microprocessor. The programmable memory receives and stores the command signal, and at the selected time automatically communicates with the microprocessor which in turn, as represented in FIG. 6, activates fluid pressure-producing system 82, so as to automatically raise or lower the lift frame.

In operation, power to the control panel is turned on, the control unit is placed into the programmable mode, and command signals for times, for instance over a twenty-four hour period, for automatic raising and lowering of lifting frame 14 are communicated to the microprocessor. The microprocessor communicates these command signals to the programmable memory, which at the selected times, via the microprocessor, automatically activates fluid pressure-producing system 82 to, if the lifting frame is to be raised, provide fluid under pressure in hydraulic lines 80. Angular movement of hydraulic device 62 occurs as the lifting frame is raised. Similarly, if the lifting frame is to be lowered, system 82 is activated to permit flow of fluid from lines 80 into the system sump. Elongated opening 60 of upper crossbar 26*a* on each side of the support frame, provides for the angular movement of the hydraulic device as the lifting frame is raised or lowered.

Figure 7:
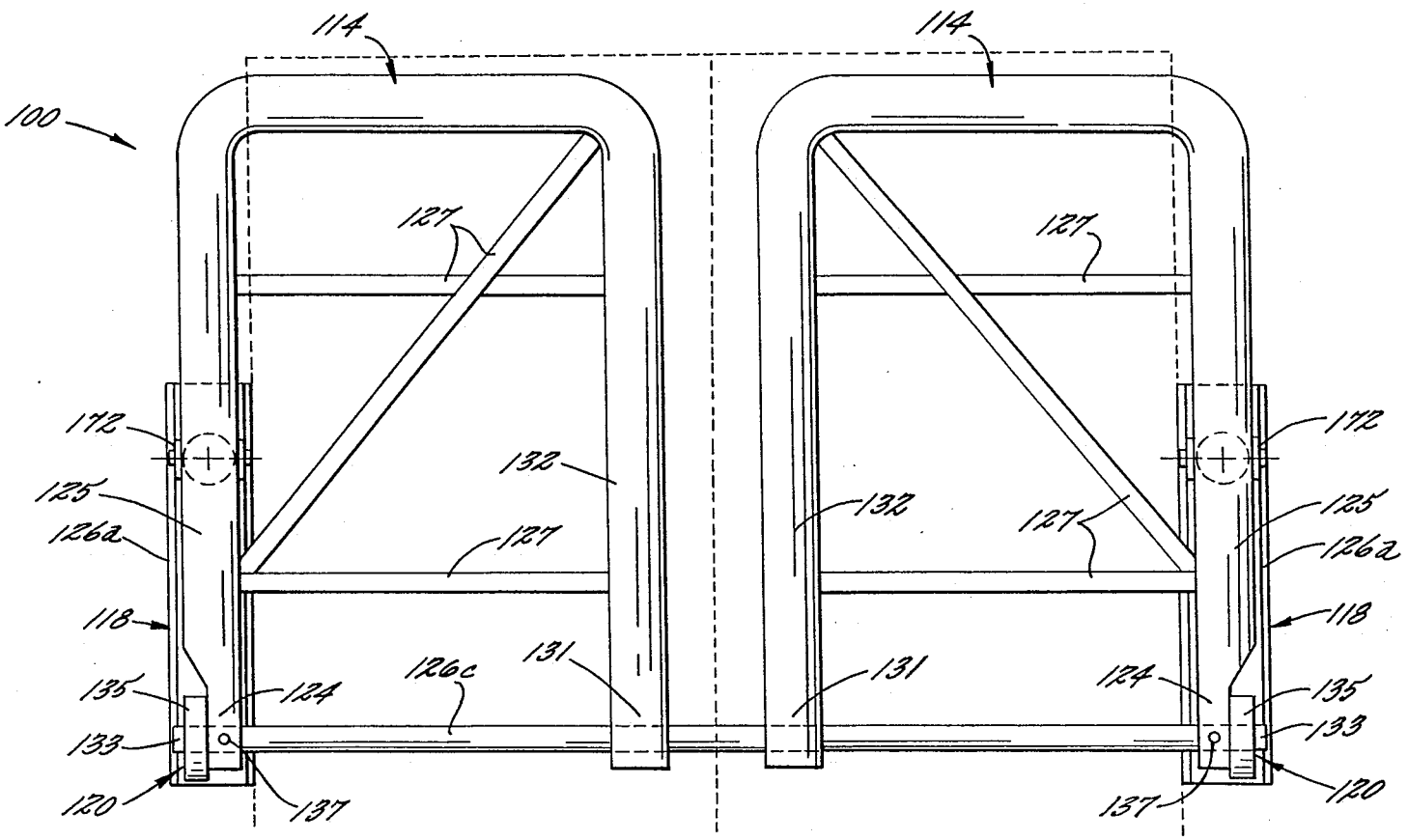
FIG. 7 is a top view, similar to FIG. 3, of an embodiment of an adjustment apparatus in accordance with the present invention, for providing adjustment of a full size bedframe, queen size bedframes, and king size bedframes.

FIG. 7 shows a top view of an apparatus 100 in accordance with the present invention, for adjusting the upper sections of a full size bed, a queen size bed, or a king size bed mattress. A mattress (shown in dotted line) is provided in two parts in order to give independent movement to each side of the mattress, and a lifting frame 114 is provided for each side of the mattress. At the same time, each mattress support (not shown, but similar to support 52 in FIG. 3) is reinforced by crossbars 127 as shown.

The lifting frames are beneficially spaced apart for safety purposes, when they go up and down alternatively. Modified apparatus 100 includes two U-shaped, lifting frames 114, and a support frame 118 at each side of the bedframe. Support frame 118 is formed in a similar manner as frame 18, by support legs (not shown) and crossbars 126*a* and 126*b* (not shown) connecting the legs, and by crossbar 126*c* (beneath the mattress) connecting hinges 120.

Hinges 120 pivotally join upper crossbars 126*a* to free ends 124 of outer arms 125 of the lifting frames, with rod ends 133 of crossbar 126*c* serving as a hinge pin. The lifting frames are strengthened by bars 127, and further supported by the hinge pin, which passes through free ends 131 of inner arms 132 of the lifting frames. Upstanding hinge brackets 135 are fixedly attached to upper crossbars 126*a* of the support frame. Cross pins 137, which pass through free ends 124 of the lifting frames and hinge pin 126*c*, lock the lifting frames and hinge pin 126*c* together.

The modified apparatus described in FIG. 7, also includes two electronic control devices, rather than one such device. In this way, each frame and mattress portion can be independently adjusted.

Except as just described, it will be understood that the modified apparatus of FIG. 7 is identical in all respects with the earlier described embodiment. Thus, for instance, U-shaped brackets 172 correspond to U-shaped brackets 72 of the first embodiment.

Having described the invention in detail and by reference to preferred embodiments thereof, it will be apparent that modifications and variations are possible without departing from the scope of the invention defined in the appended claims. Several changes or modifications have been briefly mentioned for purposes of illustration.

I claim:

1. A device for use with an existing bedframe, said device comprising a lifting frame for raising and lowering a portion of a mattress supported thereby; hinge means pivotally joining said lifting frame at a free end thereof to a support frame comprising a plurality of leg members and crossbar members connecting said leg members; said crossbar members comprising an upper crossbar member and a lower crossbar member; said hinge means being fixedly attached to said upper crossbar member, which has an elongated opening through which extends fluid operated motive means supported by and pivotally joined to said lower crossbar member on the respective side of said support frame, the motive means being pivotally joined to and directly connected to said lifting frame, said elongated opening providing for angular movement of said motive means as said lifting frame is raised and lowered by said motive means.

2. The device of claim 1, further comprising fluid pressure-producing means in fluid communication with said motive means, and microprocessor-based, control means for control of said motive means; wherein said control means comprises command means for generating command signals indicative of a selected time for an automatic selected operation of said motive means, programmable memory means for receiving and storing said command signals, and microprocessor means operatively communicating with said command means, said programmable memory means and said motive means, and responsive to said programmable memory means for automatic selected operation of said motive means at said selected time.

3. The device of claim 1, wherein said legs comprise height adjustment means.

4. The device of claim 1, further comprising a second lifting frame; wherein said crossbar members comprise a third crossbar member, and wherein free ends of said lifting frames are pivotally supported by said third crossbar which passes therethrough and through hinge brackets of hinge means fixedly attached to said support frame.

* * * * *